US009644888B2

(12) United States Patent
Ishimaru et al.

(10) Patent No.: US 9,644,888 B2
(45) Date of Patent: May 9, 2017

(54) LIQUEFIER SYSTEM

(75) Inventors: Hidetsugu Ishimaru, Kobe (JP); Toshihiro Komiya, Kamagaya (JP); Seiji Yamashita, Kobe (JP); Yoshinobu Mori, Kobe (JP); Daisuke Kariya, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 337 days.

(21) Appl. No.: 14/110,647

(22) PCT Filed: Dec. 9, 2011

(86) PCT No.: PCT/JP2011/006897

§ 371 (c)(1),
(2), (4) Date: Oct. 30, 2013

(87) PCT Pub. No.: WO2012/137270

PCT Pub. Date: Oct. 11, 2012

(65) Prior Publication Data

US 2014/0053598 A1 Feb. 27, 2014

(30) Foreign Application Priority Data

Apr. 8, 2011 (JP) ..... 2011-085979

(51) Int. Cl.

| | |
|---|---|
| ***F25J 1/02*** | (2006.01) |
| ***F01D 15/00*** | (2006.01) |
| ***F25J 1/00*** | (2006.01) |

(52) U.S. Cl.

CPC ..... *F25J 1/02* (2013.01); *F01D 15/005* (2013.01); *F25J 1/001* (2013.01); *F25J 1/004* (2013.01);

(Continued)

(58) Field of Classification Search

CPC ..... F25J 1/0204; F25J 1/0082; F25J 1/0032; F25J 1/0035; F25J 1/0037; F25J 1/004;

(Continued)

(56) References Cited

U.S. PATENT DOCUMENTS 3,105,631 A * 10/1963 Hanny ..... F01D 25/22 384/107
3,568,438 A * 3/1971 Meienberg ..... F01D 15/08 184/6

(Continued)

FOREIGN PATENT DOCUMENTS

JP A-05-172413 7/1993
JP A-06-094032 4/1994

(Continued)

OTHER PUBLICATIONS

Kumaki et al., "Linde New Helium-Liquefier and its control System," *Taiyo Nippon Sanso Technical Report*, No. 25, pp. 44-46, 2006 (With Partial Translation).

(Continued)

*Primary Examiner* — Frantz Jules
*Assistant Examiner* — Brian King
(74) *Attorney, Agent, or Firm* — Oliff PLC

(57) ABSTRACT

A liquefier system includes: a feed line configured to feed a raw material gas from a raw material supply source such that a pressure of the raw material gas in a predetermined portion of the feed line is kept higher than or equal to a predetermined pressure; a cooling medium circulation line configured to cause a cooling medium to circulate; a static pressure gas bearing configured to be supplied with the gas that has a pressure higher than or equal to the predetermined pressure and to rotatably support a rotating shaft of an expansion turbine; and a bearing supply line configured to connect the predetermined portion of the feed line and a gas inlet of the (Continued)

static pressure gas bearing, such that the gas is supplied to the static pressure gas bearing.

8 Claims, 6 Drawing Sheets

(52) U.S. Cl.
CPC ..... *F25J 1/005* (2013.01); *F25J 1/0052* (2013.01); *F25J 1/0067* (2013.01); *F25J 1/0204* (2013.01); *F25J 1/025* (2013.01); *F25J 1/0208* (2013.01); *F25J 1/0221* (2013.01); *F25J 1/0244* (2013.01); *F25J 1/0257* (2013.01); *F25J 2210/06* (2013.01); *F25J 2230/30* (2013.01); *F25J 2240/02* (2013.01); *F25J 2245/02* (2013.01); *F25J 2270/16* (2013.01)

(58) Field of Classification Search
CPC .... F25J 2270/04; F25J 2210/60; F01D 25/22; F01D 15/005
See application file for complete search history.

(56) References Cited

U.S. PATENT DOCUMENTS

| | | | | |
|---|---|---|---|---|
| 5,036,671 | A * | 8/1991 | Nelson | F25J 1/0022 62/48.2 |
| 2007/0017250 | A1* | 1/2007 | Turner | F25J 1/0204 62/613 |
| 2010/0186445 | A1* | 7/2010 | Minta | F25J 1/0022 62/606 |

FOREIGN PATENT DOCUMENTS

| | | |
|---|---|---|
| JP | A-2000-002481 | 1/2000 |
| JP | A-2000-055050 | 2/2000 |
| JP | A-2005-241232 | 9/2005 |

OTHER PUBLICATIONS

International Search Report issued in Application No. PCT/JP2011/006897; Dated Mar. 6, 2012 (With Translation).

* cited by examiner

LIQUEFIER SYSTEM

TECHNICAL FIELD

The present invention relates to liquefier systems for liquefying a raw material gas.

BACKGROUND ART

Conventionally, there are well known liquefier systems configured to liquefy a raw material gas that is in a gaseous state at normal temperatures and pressures. Examples of the raw material gas include hydrogen gas, helium gas, and neon gas. Such a liquefier system includes: a feed line for feeding the raw material gas; a cooling medium circulation line for causing a cooling medium to circulate; and a heat exchanger for cooling down the raw material gas by means of the cooling medium. While circulating through the cooling medium circulation line, the cooling medium is compressed by a compressor; adiabatically-expanded by an expansion turbine, so that the temperature of the cooling medium is reduced; then the cooling medium exchanges heat with the raw material gas at the heat exchanger, so that the temperature of the cooling medium is increased; and thereafter the cooling medium returns to the compressor.

In such a case where a cooling medium is adiabatically-expanded by an expansion turbine, a bearing is necessary for supporting a rotating shaft of the expansion turbine. If a liquid bearing is applied as the bearing for supporting the rotating shaft, there is a risk that a lubricant such as oil becomes mixed into the cooling medium that passes through the expansion turbine, and thereby the lubricant flows into the cooling medium circulation line. For this reason, preferably, a gas bearing in which the same gas as the cooling medium is used as a lubricant is applied as the bearing for supporting the rotating shaft of the expansion turbine (see Patent Literatures 1, 2, and Non Patent Literature 1).

Gas bearings are roughly categorized into static pressure gas bearings and dynamic pressure gas bearings. The load carrying capacity of a static pressure gas bearing is greater than that of a dynamic pressure gas bearing, and in the case of applying a static pressure gas bearing, friction is less likely to occur between a bearing hole surface and a rotating shaft surface at the time of start-up and stop of the liquefier system. For these reasons, the application of a static pressure gas bearing is more advantageous.

CITATION LIST

Patent Literature

PTL 1: Japanese Laid-Open Patent Application Publication No. 2000-55050

PTL 2: Japanese Laid-Open Patent Application Publication No. H06-94032

Non Patent Literature

NPL 1: Kumaki et al: "Linde New Helium-Liquefier and its Control System", TAIYO NIPPON SANSO Technical Report, No. 25, pp. 44-46, (2006)

SUMMARY OF INVENTION

Technical Problem

However, in the case of applying a static pressure gas bearing, a high-pressure gas source is necessary in order to stably supply, to the bearing, a gas having a necessary pressure for supporting the rotating shaft. In a case where a line for supplying the gas to the static pressure gas bearing from the outside is an independent line provided separately from the feed line and the cooling medium circulation line, the line needs to be provided with a dedicated compressor for use in increasing the pressure of the gas. This, however, causes an increase in the cost of the liquefier system.

It is conceivable that the line for supplying the gas to the static pressure gas bearing is formed such that the line branches off from the cooling medium circulation line at a portion through which the cooling medium flows from the compressor to the expansion turbine, and the cooling medium that has the outlet pressure of the compressor is utilized as the gas supplied to the bearing. However, when a required liquefaction amount is small, the compressor performs a part-load operation, accordingly. For this reason, there is a risk that the outlet pressure of the compressor becomes lower than the pressure necessary for supporting the rotating shaft. Therefore, in this case, the line for supplying the gas to the bearing needs to be provided with a dedicated compressor in order to stably supply, to the bearing, the gas that has the necessary pressure for supporting the rotating shaft. In this case, the dedicated compressor can be made smaller in size as compared to the case where the line for supplying the gas to the bearing is a separately provided independent line. However, there is a possibility that the dedicated compressor serves no use when the compressor on the cooling medium circulation line is in rated operation.

As described above, in the conventional art, if a static pressure gas bearing is applied as the bearing for supporting the rotating shaft of the expansion turbine, then installation of a dedicated compressor becomes necessary for stably supplying the gas to the bearing (see Patent Literatures 1 and 2). For this reason, even though a static pressure gas bearing is considered to be suitable for supporting the rotating shaft of the expansion turbine, there are cases where the application of not a static pressure gas bearing but a dynamic pressure gas bearing is chosen in consideration of a cost incurred due to the additional installation of the dedicated compressor (see Non Patent Literature 1).

In view of the above, an object of the present invention is, in the case of supporting a rotating shaft of an expansion turbine with a static pressure gas bearing, making it possible to stably supply, to the bearing, a gas having a necessary pressure for supporting the rotating shaft without requiring the installation of a dedicated compressor on a line through which the gas is supplied to the bearing.

Solution to Problem

A liquefier system according to the present invention includes: a feed line configured to feed a raw material gas from a raw material supply source such that a pressure of the raw material gas in a predetermined portion of the feed line is kept higher than or equal to a predetermined pressure; a cooling medium circulation line configured to cause a cooling medium to circulate; a heat exchanger configured to cool down the raw material gas that flows through the feed line by means of the cooling medium that flows through the cooling medium circulation line; an expansion turbine provided on the cooling medium circulation line and configured to reduce a temperature of the cooling medium by expansion; a circulation compressor provided on the cooling medium circulation line and configured to compress and guide the cooling medium to the expansion turbine; a controller configured to control operations of the expansion turbine and the circulation compressor such that a high-load operation and a low-load operation are performed, the high-load operation being an operation in which a pressure of the cooling medium that flows through a portion of the cooling medium circulation line, the portion extending from the circulation compressor to the expansion turbine, becomes higher than or equal to the predetermined pressure, the low-load operation being an operation in which the pressure of the cooling medium that flows through the portion of the cooling medium circulation line becomes lower than the predetermined pressure; a static pressure gas bearing configured to be supplied with the gas that has a pressure higher than or equal to the predetermined pressure and to rotatably support a rotating shaft of the expansion turbine; and a bearing supply line configured to connect the predetermined portion of the feed line and a gas inlet of the static pressure gas bearing, such that the gas is supplied to the static pressure gas bearing through the bearing supply line.

According to the above configuration, since the bearing supply line connects between the predetermined portion of the feed line and the gas inlet of the static pressure gas bearing, the raw material gas flowing through the feed line also flows from the predetermined portion to the bearing supply line, and is supplied to the static pressure gas bearing through the bearing supply line. The pressure of the raw material gas in the predetermined portion of the feed line is kept higher than or equal to the predetermined pressure. This makes it possible to stably supply the gas having a pressure higher than or equal to the predetermined pressure to the static pressure gas bearing and stably support the rotating shaft of the expansion turbine regardless of the operating state of the circulation compressor and the pressure of the cooling medium without requiring the installation of a dedicated compressor on the bearing supply line.

The predetermined portion may be positioned upstream from the heat exchanger on the feed line.

According to the above configuration, the gas that has a normal temperature can be supplied to the static pressure gas bearing.

The liquefier system may further include a pressure regulating valve provided on the bearing supply line and configured to reduce the pressure of the gas that flows through the bearing supply line.

The above configuration makes it possible to both keep the pressure of the raw material gas at a sufficiently high pressure for liquefaction of the raw material gas and adjust the pressure of the gas supplied to the static pressure gas bearing to a necessary pressure for supporting the rotating shaft.

The liquefier system may further include: a feeding compressor provided on the feed line at a position upstream from the predetermined portion and configured to compress the raw material gas; and a bearing gas return line configured to connect a gas outlet of the static pressure gas bearing and a portion of the feed line, the portion being positioned upstream from the feeding compressor, such that the gas that flows out of the gas outlet is returned to the feed line.

According to the above configuration, the gas that flows out of the static pressure gas bearing can be reused as both the raw material gas and the gas supplied to the bearing.

The liquefier system may further include a boil-off gas return line through which a boil-off gas is returned to the feed line. The boil-off gas return line may be connected to the bearing gas return line.

According to the above configuration, not only the gas flowing out of the static pressure gas bearing but also the boil-off gas can be reused as both the raw material gas and the gas supplied to the bearing.

The cooling medium may be the same as the raw material gas.

Accordingly, even if the gas supplied to the static pressure gas bearing and the cooling medium circulating through the cooling medium circulation line are mixed together in the expansion turbine, problems caused when different kinds of gases are mixed together do not arise. In the expansion turbine, there is a possibility of leakage of the cooling medium. However, even if a leakage of the cooling medium occurs, the cooling medium lost due to the leakage can be replenished by the gas supplied to the static pressure gas bearing.

The liquefier system may further include: a bearing gas return line configured to connect a gas outlet of the static pressure gas bearing and a portion of the cooling medium circulation line, the portion extending from the expansion turbine to the compressor, such that the gas that flows out of the gas outlet is sent to the cooling medium circulation line.

According to the above configuration, the gas flowing out of the static pressure gas bearing can be reused as the cooling medium. It should be noted that since the gas supplied to the bearing is the same as the cooling medium, problems caused when different kinds of gases are mixed together do not arise, and thus the gas can be reused.

Advantageous Effects of Invention

As described above, the present invention makes it possible to provide a liquefier system capable of stably supplying, to a static pressure gas bearing, a gas having a necessary pressure for supporting a rotating shaft of an expansion turbine without requiring the installation of a dedicated compressor on a line through which the gas is supplied to the static pressure gas bearing. The above and further objects, features, and advantages of the present invention will more fully be apparent from the following detailed description of embodiments with accompanying drawings.

DESCRIPTION OF EMBODIMENTS

Figure 1:
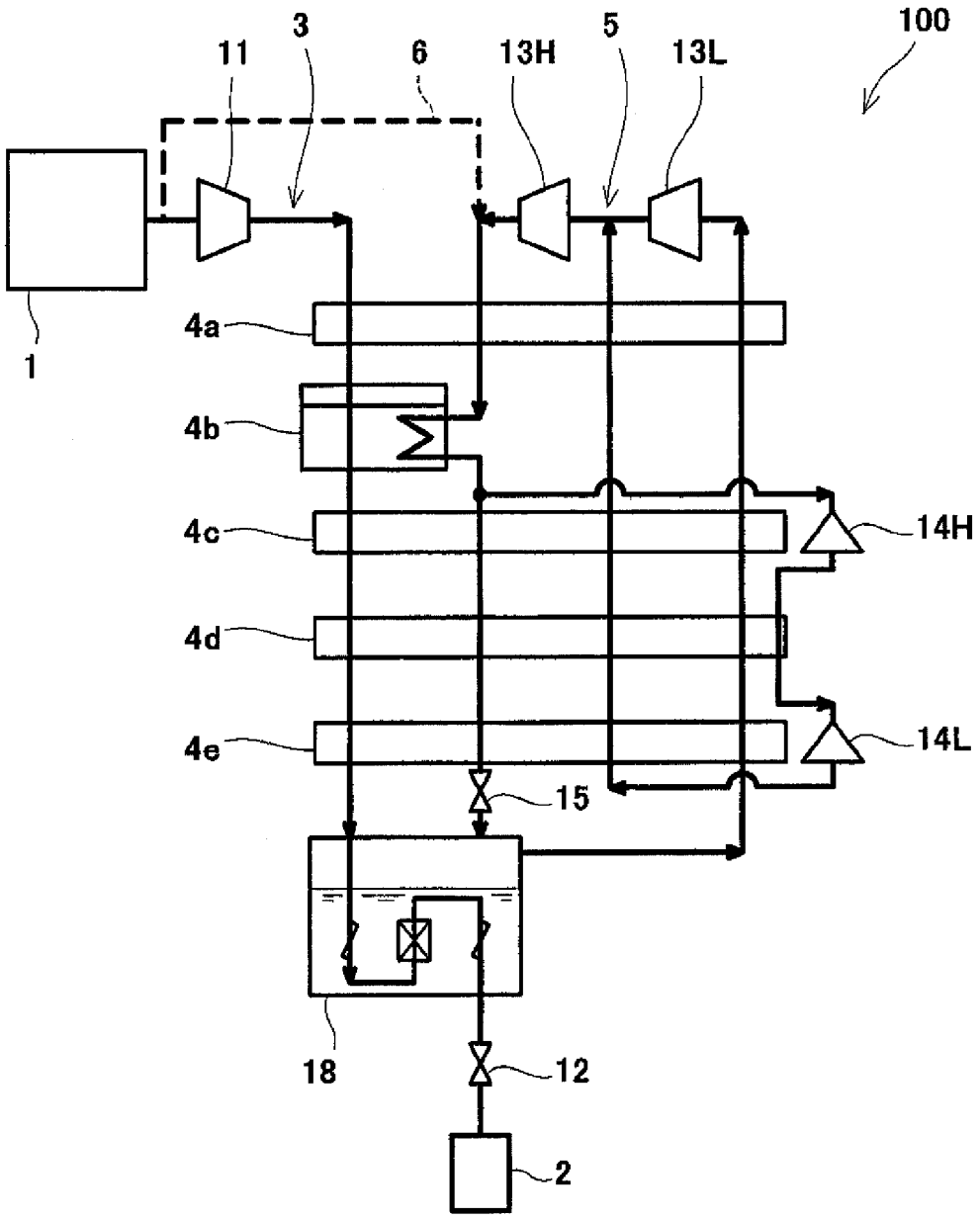
FIG. 1 is a conceptual diagram showing an overall configuration of a liquefier system according to Embodiment 1 of the present invention.

Hereinafter, embodiments of the present invention will be described with reference to the accompanying drawings. In the drawings, the same or corresponding elements are denoted by the same reference signs, and a repetition of the same detailed description is avoided.

Embodiment 1

FIG. 1 is a conceptual diagram showing an overall configuration of a liquefier system 100 according to Embodiment 1 of the present invention. The liquefier system 100 shown in FIG. 1 liquefies a raw material gas that is in a gaseous state at normal temperatures and pressures. The raw material gas to be liquefied by the liquefier system 100 is a gas whose boiled point is extremely low and close to absolute zero, and is in a gaseous state at normal temperatures and pressures. Examples of the raw material include hydrogen gas, helium gas, and neon gas. In the present embodiment, a description is given on the assumption that a hydrogen gas is applied as the raw material gas unless otherwise specified.

The liquefier system 100 includes: a raw material tank 1; a liquefied hydrogen tank 2; a feed line 3; a plurality of heat exchangers 4*a* to 4*e*; a liquid reservoir 18; and a cooling medium circulation line 5. The raw material tank 1 is a source of supply of the raw material gas, and stores the hydrogen gas at a normal temperature and pressure. The liquefied hydrogen tank 2 stores liquefied hydrogen which is obtained by liquefying the hydrogen gas.

The feed line 3 connects between the raw material tank 1 and the liquefied hydrogen tank 2. A feeding compressor 11 and a Joule-Thomson valve 12 are provided on the feed line 3. Between the feeding compressor 11 and the Joule-Thomson valve 12, the feed line 3 extends sequentially through the five heat exchangers 4*a* to 4*e* and the liquid reservoir 18. Thus, the Joule-Thomson valve 12 is provided upstream from the liquefied hydrogen tank 2, and desirably, provided at a position immediately before the liquefied hydrogen tank 2 (i.e., a position downstream from the liquid reservoir 18).

The hydrogen gas in the raw material tank 1 is fed to the liquefied hydrogen tank 2 through the feed line 3. During this process, first, the pressure of the hydrogen gas is increased at the feeding compressor 11. After passing through the feeding compressor 11, the normal-temperature and high-pressure hydrogen gas passes through the heat exchangers 4*a* to 4*e* and the liquid reservoir 18. Accordingly, the hydrogen gas is gradually cooled down while its pressure is kept high. It should be noted that the second heat exchanger 4*b* is a liquid nitrogen tank storing liquid nitrogen. By passing through the heat exchanger 4*b*, the hydrogen gas is cooled down to a temperature that is close to the temperature of the liquid nitrogen. The cooling medium circulation line 5 is connected to the other heat exchangers 4*a*, 4*c*, 4*d*, 4*e*, and the liquid reservoir 18. When passing through the heat exchangers 4*a*, 4*c*, 4*d*, 4*e*, and the liquid reservoir 18, the hydrogen gas exchanges heat with the cooling medium flowing through the cooling medium circulation line 5, and thereby the hydrogen gas is cooled down. After passing through the liquid reservoir 18, the low-temperature and high-pressure hydrogen gas passes through the Joule-Thomson valve 12. As a result, the hydrogen gas expands and is liquefied, so that the hydrogen gas becomes a low-temperature and normal-pressure liquid. The hydrogen in the liquid state is sent to the liquefied hydrogen tank 2, and stored in the liquefied hydrogen tank 2.

The cooling medium for cooling down the raw material gas circulates through the cooling medium circulation line 5. The cooling medium circulation line 5 is connected to the feed line 3 via a cooling medium loading line 6. The cooling medium loading line 6 is opened before the liquefier system 100 starts operating. This allows the hydrogen gas in the raw material tank 1 to be loaded into the cooling medium circulation line 5. The cooling medium loading line 6 is closed while the liquefier system 100 is in operation. As a result, the cooling medium circulation line 5 forms a closed loop, and the hydrogen gas that serves as the cooling medium circulates through the cooling medium circulation line 5. Thus, in the present embodiment, the cooling medium is the same hydrogen gas as the raw material gas.

Two compressors (a high-pressure circulation compressor 13H and a low-pressure circulation compressor 13L) and two expansion turbines (a high-pressure expansion turbine 14H and a low-pressure expansion turbine 14L) are provided on the cooling medium circulation line 5. The high-pressure circulation compressor 13H and the low-pressure circulation compressor 13L are arranged in series. The high-pressure expansion turbine 14H and the low-pressure expansion turbine 14L are arranged in series. The low-pressure circulation compressor 13L compresses the cooling medium and guides the compressed cooling medium to the high-pressure circulation compressor 13H. The high-pressure circulation compressor 13H compresses the cooling medium from the low-pressure circulation compressor 13L, and guides the compressed cooling medium to the high-pressure expansion turbine 14H.

While the cooling medium is being guided to the high-pressure expansion turbine 14H, the cooling medium passes through the first heat exchanger 4*a* and then passes through the second heat exchanger 4*b*. Accordingly, the temperature and pressure of the cooling medium are reduced through heat exchange with coldness, which will be described below. The cooling medium that has been cooled down to a temperature that is close to the temperature of the liquid nitrogen is guided to the high-pressure expansion turbine 14H. The high-pressure expansion turbine 14H causes, by expansion, the temperature and pressure of the low-temperature and high-pressure cooling medium guided from the circulation compressors 13L and 13H to decrease. The cooling medium from the high-pressure expansion turbine 14H passes through the fourth heat exchanger 4*d*, and is guided to the low-pressure expansion turbine 14L. The low-pressure expansion turbine 14L also causes, by expansion, the temperature and pressure of the low-temperature and high-pressure cooling medium guided from the high-pressure expansion turbine 14H to decrease.

The cooling medium from the low-pressure expansion turbine 14L passes through the fifth heat exchanger 4*e*, the fourth heat exchanger 4*d*, the third heat exchanger 4*c*, and the first heat exchanger 4*a* in said order, so that the temperature of the cooling medium increases. After passing through the first heat exchanger 4*a*, the cooling medium merges with the cooling medium that has been compressed by the low-pressure circulation compressor 13L, and is returned to the inlet of the high-pressure circulation compressor 13H.

The cooling medium from the high-pressure circulation compressor 13H is, after passing through the second heat exchanger 4*b*, divided into one flow of the cooling medium directed to the aforementioned expansion turbines 14H and 14L and the other flow of the cooling medium directed to the liquid reservoir 18. The cooling medium directed to the liquid reservoir 18 further passes through the third heat exchanger 4*c*, the fourth heat exchanger 4*d*, and the fifth heat exchanger 4*e* in said order, so that the temperature of the cooling medium decreases. Thereafter, the cooling medium passes through a Joule-Thomson valve 15 and is liquefied, then sent to the liquid reservoir 18. The cooling medium in the liquid reservoir 18 cools down the hydrogen gas that has reached the liquid reservoir 18 through the feed line 3. The cooling medium from the liquid reservoir 18 passes through the fifth heat exchanger 4*e*, the fourth heat exchanger 4*d*, the third heat exchanger 4*c*, and the first heat exchanger 4*a* in said order, so that the temperature of the cooling medium increases. Thereafter, the cooling medium is returned to the inlet of the low-pressure circulation compressor 13L. As described above, at the heat exchangers 4*a*, 4*c*, 4*d*, and 4*e*, the coldness of the cooling medium flowing from the low-pressure expansion turbine 14L to the high-pressure circulation compressor 13H, and the coldness of the cooling medium flowing from the liquid reservoir 18 to the low-pressure circulation compressor 13L, are utilized to cool down the raw material gas and the cooling medium.

Figure 2:
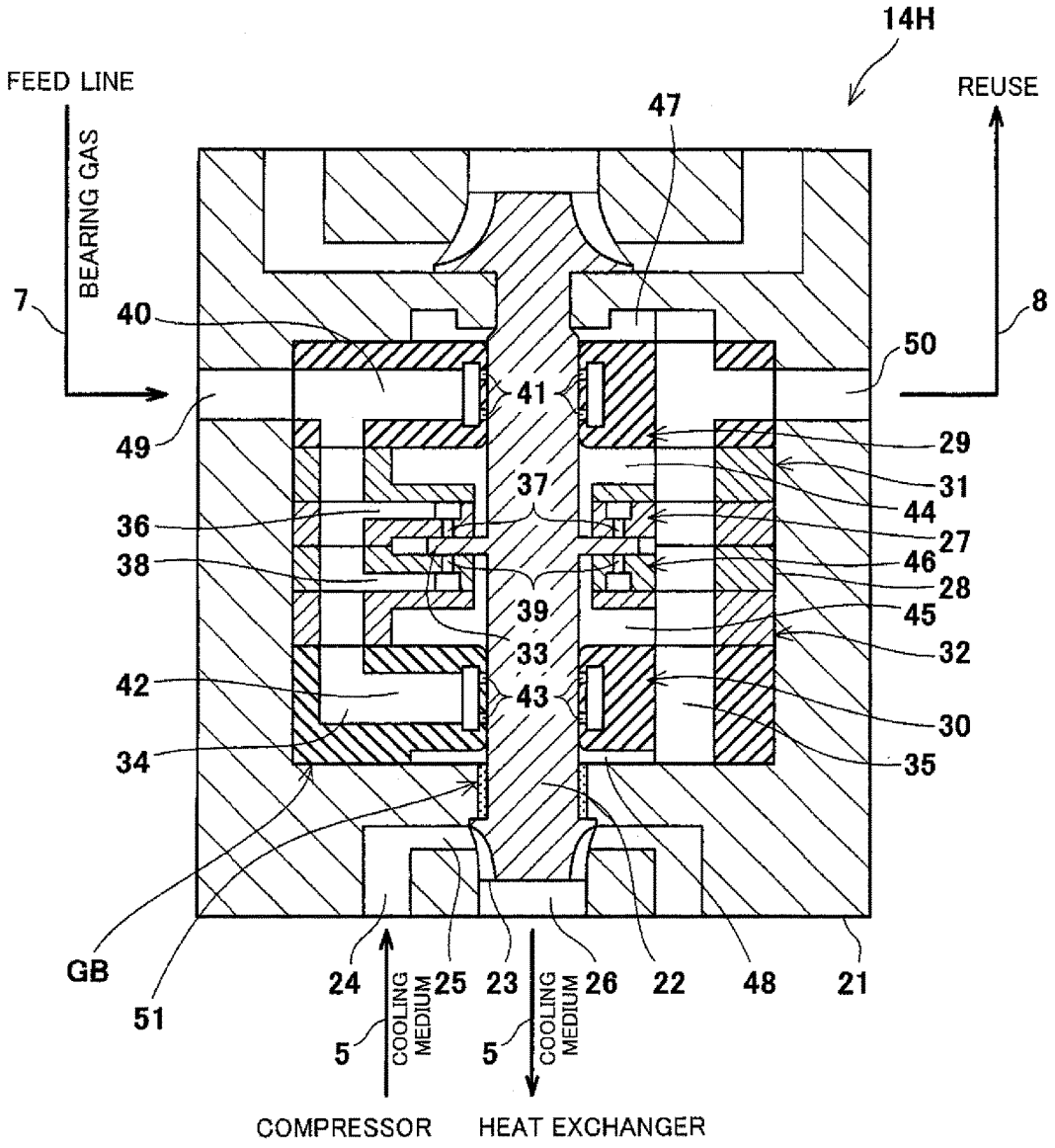
FIG. 2 is a sectional view showing a configuration of an expansion turbine shown in FIG. 1.

FIG. 2 is a sectional view showing a configuration of the high-pressure expansion turbine 14H shown in FIG. 1. It should be noted that the low-pressure expansion turbine 14L has the same configuration as the one shown in FIG. 2. As shown in FIG. 2, the high-pressure expansion turbine 14H includes a housing 21, a rotating shaft 22, and a turbine impeller 23. The rotating shaft 22 extends vertically inside the housing 21, and is supported so as to be rotatable around a vertical axis. The turbine impeller 23 is formed at the lower end of the rotating shaft 22.

The housing 21 includes a cooling medium inlet 24, a nozzle 25, and a cooling medium outlet 26. The cooling medium inlet 24 is open at the bottom of the housing 21. One end of the nozzle 25 is in communication with the cooling medium inlet 24, and the other end of the nozzle 25 is in communication with a turbine impeller accommodating portion inside the housing 21, the portion accommodating the turbine impeller 23. The cooling medium outlet 26 is open at the central bottom portion of the housing 21, and as a result, the portion accommodating the turbine impeller 23 is in communication with the outside of the housing 21.

The cooling medium inlet 24 is connected to the downstream end of a passage of the cooling medium circulation line 5, the passage extending from the high-pressure circulation compressor 13H to the high-pressure expansion turbine 14H. The cooling medium outlet 26 is connected to the upstream end of a passage of the cooling medium circulation line 5, the passage extending from the high-pressure expansion turbine 14H through the heat exchanger 4*d* to the low-pressure expansion turbine 14L. The cooling medium from the high-pressure circulation compressor 13H flows into the housing 21 through the cooling medium inlet 24. The cooling medium that has flowed in through the cooling medium inlet 24 is injected from the other end of the nozzle 25 to the turbine impeller 23. Due to rotation of the turbine impeller 23, the cooling medium expands and the temperature of the cooling medium is reduced. Thereafter, the cooling medium flows to the outside of the housing 21 through the cooling medium outlet 26.

A static pressure gas bearing unit GB is provided within the housing 21. The static pressure gas bearing unit GB includes: an upper static pressure thrust gas bearing 27; a lower static pressure thrust gas bearing 28; an upper static pressure journal gas bearing 29; a lower static pressure journal gas bearing 30; an upper block 31; and a lower block 32. These six components 27 to 32 are formed in a substantially cylindrical shape, and are provided in a manner to surround the outer periphery of the rotating shaft 22, such that the components 27 to 32 are arranged in the axial direction of the rotating shaft 22. The upper static pressure thrust gas bearing 27 and the lower static pressure thrust gas bearing 28 are arranged in a manner to vertically sandwich a thrust collar 33 which radially protrudes from the vertically central portion of the rotating shaft 22. The upper static pressure thrust gas bearing 27 and the lower static pressure thrust gas bearing 28 are in contact with each other at a position that is outwardly away from the outer edge of the thrust collar 33. The upper static pressure journal gas bearing 29 and the upper static pressure thrust gas bearing 27 are arranged in a manner to vertically sandwich the upper block 31. The lower static pressure journal gas bearing 30 and the lower static pressure thrust gas bearing 28 are arranged in a manner to vertically sandwich the lower block 32.

The static pressure gas bearing unit GB includes a shared gas supply passage 34 and a shared exhaust passage 35. The shared gas supply passage 34 and the shared exhaust passage 35 are formed at their respective positions that are away from each other in the circumferential direction. The shared gas supply passage 34 and the shared exhaust passage 35 both extend in the axial direction through the six components 27 to 32. The shared gas supply passage 34 is a passage through which a bearing gas supplied to the bearing clearance of each static pressure gas bearing flows. The shared exhaust passage 35 is a passage through which the bearing gas that is discharged from the bearing clearance of each static pressure gas bearing flows. It should be noted that the bearing clearance of the upper static pressure thrust gas bearing 27 is formed between the lower end face of the gas bearing 27 and the upper end face of the thrust collar 33; the bearing clearance of the lower static pressure thrust gas bearing 28 is formed between the upper end face of the gas bearing 28 and the lower end face of the thrust collar 33; the bearing clearance of the upper static pressure journal gas bearing 29 is formed between the inner peripheral surface of the gas bearing 29 and the outer peripheral surface of the rotating shaft 22; and the bearing clearance of the lower static pressure journal gas bearing 30 is formed between the inner peripheral surface of the gas bearing 30 and the outer peripheral surface of the rotating shaft 22.

The static pressure gas bearings 27, 28, 29, and 30 include gas supply grooves 36, 38, 40, 42 and gas inlets 37, 39, 41, 43. Inside the bearings 27, 28, 29, and 30, the gas supply grooves 36, 38, 40, and 42 extend from the shared gas supply passage 34 toward the inner peripheral side. The gas inlets 37, 39, 41, and 43 allow corresponding gas supply grooves 36, 38, 40, and 42 to be in communication with bearing clearances. The gas supply grooves 36 and 38 of the static pressure thrust gas bearings 27 and 28 extend in the axial direction, and the gas supply grooves 40 and 42 of the static pressure journal gas bearings 29 and 30 extend in the radial direction. The gas supply groove 40 is provided at two positions that are away from each other in the axial direction and are spaced apart from each other in the circumferential direction. The same is true of the gas supply groove 42.

The upper block 31 and the lower block 32 include exhaust grooves 44 and 45. The exhaust groove 44 of the upper block 31 allows the inner peripheral side of the bearing clearance of the upper static pressure thrust gas bearing 27 and the lower side of the bearing clearance of the upper static pressure journal gas bearing 29 to be in communication with the shared exhaust passage 35. The exhaust groove 45 of the lower block 32 allows the inner peripheral side of the bearing clearance of the lower static pressure thrust gas bearing 28 and the upper side of the bearing clearance of the lower static pressure journal gas bearing 30 to be in communication with the shared exhaust passage 35. It should be noted that the outer peripheral side of the bearing clearance of each of the static pressure thrust gas bearings 27 and 28 is in communication with the shared exhaust passage 35 via an exhaust groove 46 formed in each of the bearings 27 and 28. The upper side of the bearing clearance of the upper static pressure journal gas bearing 29 is in communication with the shared exhaust passage 35 via an exhaust groove 47 formed in the housing 21. The lower side of the bearing clearance of the lower static pressure journal gas bearing 30 is in communication with the shared exhaust passage 35 via an exhaust groove 48 formed in the lower part of the bearing 30.

The housing 21 includes a bearing gas inlet 49 and a bearing gas outlet 50. The bearing gas inlet 49 is in communication with the shared gas supply passage 34. The bearing gas outlet 50 is in communication with the shared exhaust passage 35. The bearing gas inlet 49 is connected to the downstream end of a bearing supply line 7. The bearing supply line 7 supplies a high-pressure bearing gas to the static pressure gas bearing unit GB in the housing 21 of the expansion turbine 14H. In the present embodiment, as described below, the source of supply of the bearing gas is the feed line 3, and a hydrogen gas is utilized as the bearing gas. The bearing gas outlet 50 is connected to the upstream end of a bearing gas return line 8.

The bearing gas from the bearing supply line 7 flows into the shared gas supply passage 34 through the bearing gas inlet 49. The bearing gas having flowed into the shared gas supply passage 34 is injected to the bearing clearances of the static pressure gas bearings 27, 28, 29, and 30 thorough the gas inlets 37, 39, 41, and 43. The bearing gas injected to the bearing clearances is discharged to the shared exhaust passage 35 through the exhaust grooves 44 to 48. The bearing gas in the shared exhaust passage 35 flows to the outside of the housing 21 through the bearing gas outlet 50. The bearing gas having flowed to the outside of the housing 21 is sent to a reuse destination through the bearing gas return line 8 for reuse of the hydrogen gas.

Since the high-pressure bearing gas is supplied to the bearing clearances of the static pressure gas bearings 27 to 30 as described above, the rotating shaft 22 can be rotatably supported within the housing 21. As a result, radial and thrust loads on the rotating shaft 22 can be favorably supported. At the time of start-up and stop, no friction occurs between the outer peripheral surface of the rotating shaft 22 and the inner peripheral surface of the static pressure journal gas bearings 29 and 30. This makes it possible to extend the life of the high-pressure expansion turbine 14H and the static pressure journal gas bearings 29 and 30. It should be noted that a labyrinth structure 51 is provided between the bearing clearance of the lower static pressure journal gas bearing 30 and the turbine impeller accommodating portion inside the housing 21, the portion accommodating the turbine impeller 23. This makes it possible to favorably suppress the drawing of the bearing gas injected to the bearing clearance of the gas bearing 30 into the portion accommodating the turbine impeller 23. In the present embodiment, the bearing gas is the same as the raw material gas, and the cooling medium is the same as the raw material gas. Therefore, even if the bearing gas is mixed into the cooling medium beyond the labyrinth structure 51, there is not a risk of a different kind of gas being mixed into the cooling medium.

Figure 3:
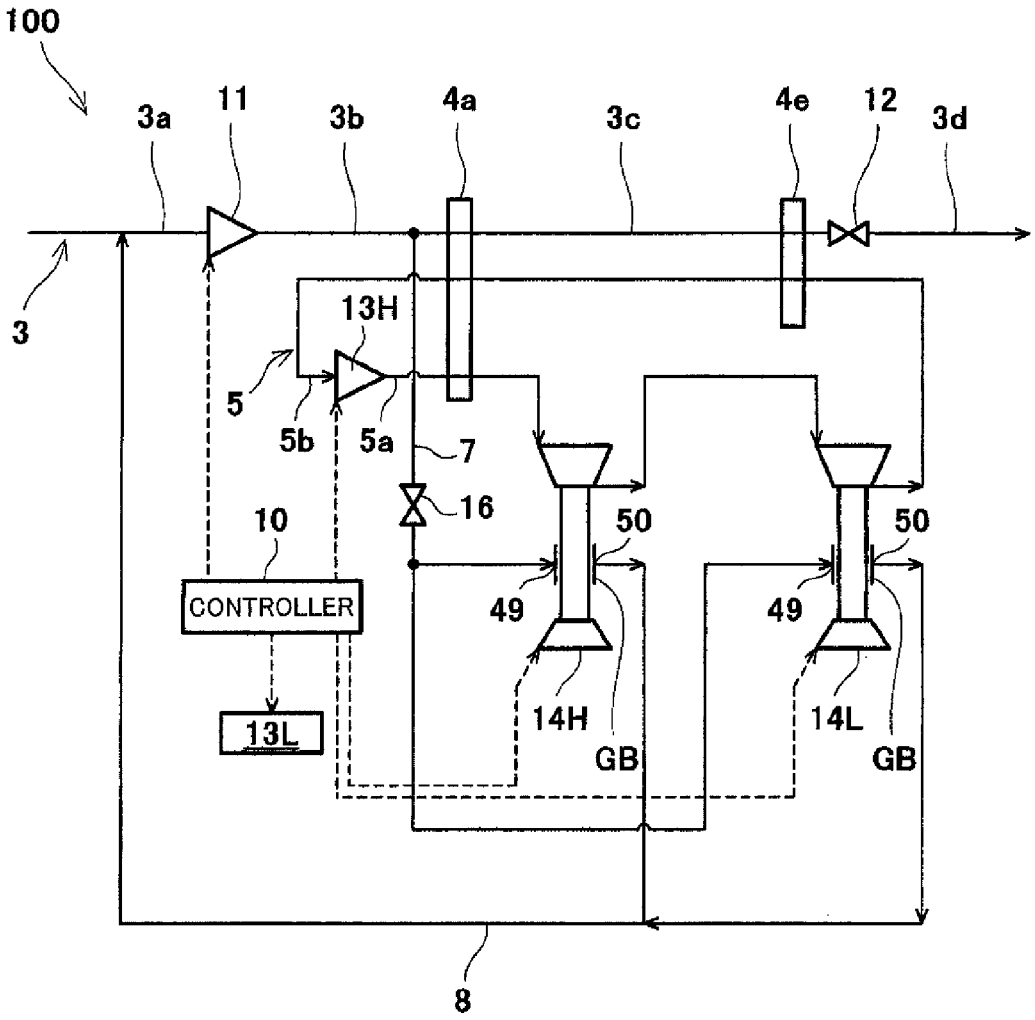
FIG. 3 is a conceptual diagram showing a configuration of main parts of the liquefier system shown in FIG. 1.

FIG. 3 is a conceptual diagram showing a configuration of main parts of the liquefier system 100 shown in FIG. 1. For the sake of convenience of the description, FIG. 3 does not show the following: the second to fourth heat exchangers 4*b*, 4*c*, and 4*d*; the liquid reservoir 18; the cooling medium loading line 6; a passage of the cooling medium circulation line 5, the passage turning around at the liquid reservoir 18; and the low-pressure circulation compressor 13L. Of the cooling medium circulation line 5, FIG. 3 shows an outward passage 5*a* and a return passage 5*b*. The outward passage 5*a* extends from the outlet of the high-pressure circulation compressor 13H to the inlet of the low-pressure expansion turbine 14L. The return passage 5*b* extends from the outlet of the low-pressure expansion turbine 14L to the inlet of the high-pressure circulation compressor 13H.

Reference signs 3*a* to 3*d* in FIG. 3 indicate passages forming the feed line 3. The reference sign 3*a* indicates a first passage extending from the raw material tank 1 (see FIG. 1) to the inlet of the feeding compressor 11; the reference sign 3*b* indicates a second passage extending from the outlet of the feeding compressor 11 to the first heat exchanger; the reference sign 3*c* indicates a third passage extending from the first heat exchanger 4*a* to the inlet of the Joule-Thomson valve 12; and the reference sign 3*d* indicates a fourth passage extending from the outlet of the Joule-Thomson valve 12 to the liquefied hydrogen tank 2 (see FIG. 1).

As shown in FIG. 3, the liquefier system 100 includes a controller 10. The controller 10 is a microcomputer whose main components are a CPU, a ROM, and an input/output interface. The input of the controller 10 receives: a command to start up the system; a command to stop the system; and a setting value of a liquefaction amount. The input of the controller 10 also receives measurement values of process data (e.g., temperatures, pressures, and flow rates of the raw material gas and the cooling medium, and a liquefaction amount) of the liquefier system 100. The output of the controller 10 is connected to the feeding compressor 11, the high-pressure circulation compressor 13H, the low-pressure circulation compressor 13L, the high-pressure expansion turbine 14H, and the low-pressure expansion turbine 14L. The CPU executes a control program stored in the ROM. While monitoring the measurement values of the process data, the CPU controls the feeding compressor 11, the high-pressure circulation compressor 13H, the low-pressure circulation compressor 13L, the high-pressure expansion turbine 14H, and the low-pressure expansion turbine 14L so that the liquefaction amount can be obtained as set.

In order to accelerate the liquefaction by the Joule-Thomson effect, it is preferable that the inlet pressure of the Joule-Thomson valve 12 be high regardless of the flow rate or liquefaction amount of the raw material gas. Accordingly, the feeding compressor 11 is controlled to perform a constant-pressure operation regardless of the setting value of the liquefaction amount. When the setting value of the liquefaction amount is a rated value, the circulation compressors 13H and 13L and the expansion turbines 14H and 14L are controlled to perform a rated operation. On the other hand, when the setting value of the liquefaction amount is less than the rated value, the circulation compressors 13H and 13L and the expansion turbines 14H and 14L are controlled to perform a part-load operation. Thus, the controller 10 controls the operations of the circulation compressors 13H and 13L and the expansion turbines 14H and 14L so that a high-load operation and a low-load operation can be performed. As a result, coldness is generated corresponding to a setting value of either a raw material gas flow rate or a raw material gas liquefaction amount. This makes it possible to suitably prevent, when the setting value of the liquefaction amount is small, the high-pressure circulation compressor 13H and the low-pressure circulation compressor 13L from operating wastefully to produce excessive coldness. Various methods are adoptable to realize such control. Any method may be adopted, so long as the adopted method is a control method for varying the load on the circulation compressors in relation to a load (liquefaction amount) setting value.

Figure 4:
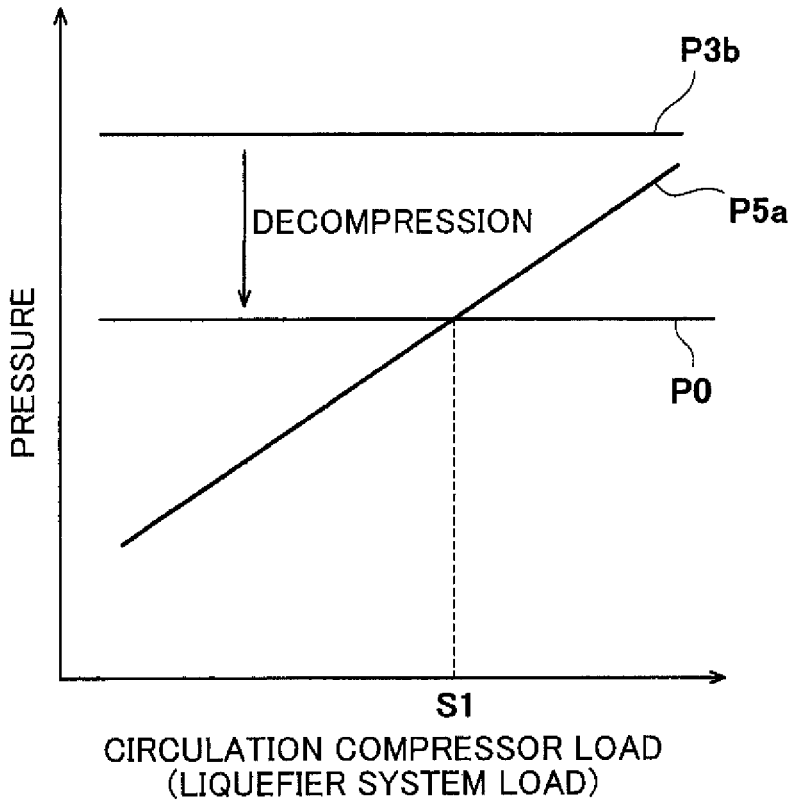
FIG. 4 is a diagrammatic drawing showing the pressure of a raw material gas and the pressure of a cooling medium in relation to a load on circulation compressors.

FIG. 4 is a diagrammatic drawing showing the pressure of the raw material gas and the pressure of the cooling medium in relation to the load on the circulation compressors 13H and 13L. The horizontal axis of FIG. 4 represents the load on the circulation compressors 13H and 13L (corresponding to the liquefaction amount setting value). The vertical axis of FIG. 4 represents pressure. A line P3*b* represents the pressure of the raw material gas in the second passage 3*b* of the feed line 3. A line P5*a* represents the pressure of the cooling medium that flows through the outward passage 5*a* of the cooling medium circulation line 5. A line P0 is one example of pressure that is necessary for the static pressure gas bearing unit GB to rotatably support the rotating shaft 22 while supporting radial and thrust loads on the rotating shaft 22. The line P0 represents a minimum required value of the pressure of the bearing gas supplied to the bearing gas inlet 49 (hereinafter, referred to as a "predetermined pressure").

As shown in FIG. 4, the predetermined pressure P0 is substantially constant regardless of changes in the load on the circulation compressors 13H and 13L. The pressure P3*b* of the raw material gas flowing through the second passage 3*b* is also substantially constant regardless of changes in the load on the circulation compressors 13H and 13L. Moreover, the pressure P3*b* is kept at a high value that is higher than or equal to the predetermined pressure P0 in order to accelerate the aforementioned liquefaction by the Joule-Thomson effect.

The pressure P5*a* of the cooling medium flowing through the outward passage 5*a* varies in accordance with changes in the load on the circulation compressors 13H and 13L. In an operating state S1 where a part-load operation is performed, the pressure P5*a* is equal to the predetermined pressure P0. While a high-load operation is being performed, in which the load on the circulation compressors 13L and 13H is higher than in the operating state S1, the pressure P5*a* becomes higher than the predetermined pressure P0. While a low-load operation is being performed, in which the load on the circulation compressors 13L and 13H is lower than in the operating state S1, the pressure P5*a* becomes lower than the predetermined pressure P0. In a case where the cooling medium flowing through the outward passage 5*a* is utilized as the source of the bearing gas, the bearing supply line 7 needs to be provided with a dedicated compressor, otherwise the rotating shaft 22 of each of the expansion turbines 14H and 14L cannot be favorably supported while the low-load operation is being performed.

As shown in FIG. 3, in the present embodiment, the upstream end of the bearing supply line 7 is connected to the second passage 3*b* of the feed line 3, and the raw material gas that flows through the second passage 3*b* is utilized as the source of supply of the bearing gas. As previously described, the raw material gas flowing through the second passage 3*b* has a high pressure that is higher than or equal to the predetermined pressure P0 regardless of the liquefaction amount setting value and the like. Therefore, even if a dedicated compressor for increasing the pressure of the bearing gas is not provided on the bearing supply line 7, the bearing gas having a pressure higher than or equal to the predetermined pressure P0 can be stably supplied to the static pressure gas bearing unit GB regardless of the operating state of the circulation compressors 13H and 13L and the expansion turbines 14H and 14L. This makes it possible to obtain advantages provided by the application of the static pressure gas bearings 27 to 30 while preventing an increase in the cost of the liquefier system 100. That is, the load carrying capacity can be increased, and even if the starting up and stopping of the liquefier system 100 are repeated, the wear of the static pressure gas bearing unit GB and the rotating shaft 22 do not advance easily.

In the first passage 3*a*, the raw material gas at a normal pressure flows. In the fourth passage 3*d*, the raw material gas at a normal pressure flows in a liquid state. In the third passage 3*c*, the raw material gas at a high pressure flows toward the inlet of the Joule-Thomson valve 12 in such a manner that the raw material gas is maintained in a gaseous state and decrease in the pressure of the raw material gas is minimized. Accordingly, the pressure of the raw material gas flowing through the third passage 3*c* is kept at a high value that is higher than or equal to the predetermined pressure P0 regardless of changes in the load on the circulation compressors 13H and 13L. In the present embodiment, of the raw material gas that has a pressure higher than or equal to the predetermined pressure P0 and that flows in a gaseous state, the raw material gas flowing through the second passage 3*b* disposed upstream from the first heat exchanger 4*a* is utilized as the bearing gas. This allows the temperature of the bearing gas to be a normal temperature. Alternatively, the raw material gas flowing through the third passage 3*c* may be utilized as the bearing gas. In this case, a temperature difference between the cooling medium and the bearing gas in the housing 21 is small, which makes it possible to reduce thermal influence of the bearing gas on the cooling medium.

A pressure regulating valve 16 for reducing the pressure of the bearing gas is installed on the bearing supply line 7. The installation of the pressure regulating valve 16 makes it possible to both keep the pressure of the raw material gas flowing through the second passage 3*b* at a sufficiently high pressure for liquefaction of the raw material gas and adjust the pressure of the bearing gas supplied to the static pressure gas bearing unit GB to a necessary pressure for supporting the rotating shaft 22.

In the present embodiment, two expansion turbines 14H and 14L are provided on the cooling medium circulation line 5. The downstream portion of the bearing supply line 7 is divided into two passages, and the two passages are connected to the two respective bearing gas inlets of the expansion turbines 14H and 14L. This makes it possible to stably supply a high-pressure bearing gas to the static pressure gas bearings included in the expansion turbines. Since the bearing supply line 7 is divided into two passages at a position downstream from the pressure regulating valve 16, the bearing gas that has been decompressed and thereby adjusted can be supplied to both of the expansion turbines 14H and 14L.

The bearing gas return line 8 connects the bearing gas outlet 50 of each of the two expansion turbines 14H and 14L to the first passage 3*a* of the feed line 3. Accordingly, the bearing gas that is discharged from the bearing gas outlet 50 is returned to the first passage 3*a* through the bearing gas return line 8, and is reused as the raw material gas and the bearing gas. Although the bearing gas has a high pressure at the bearing gas inlet 49, the pressure of the bearing gas is reduced as a result of passing through the bearing clearances, and the pressure of the bearing gas becomes substantially a normal pressure at the bearing gas outlet 50. For this reason, it is difficult to return the bearing gas to the second passage 3*b* which is downstream from the feeding compressor 11. However, as in the present embodiment, in a case where the bearing gas is returned to the first passage 3*a* which is upstream from the feeding compressor 11, the bearing gas can be returned without increasing its pressure.

Embodiment 2

Figure 5:
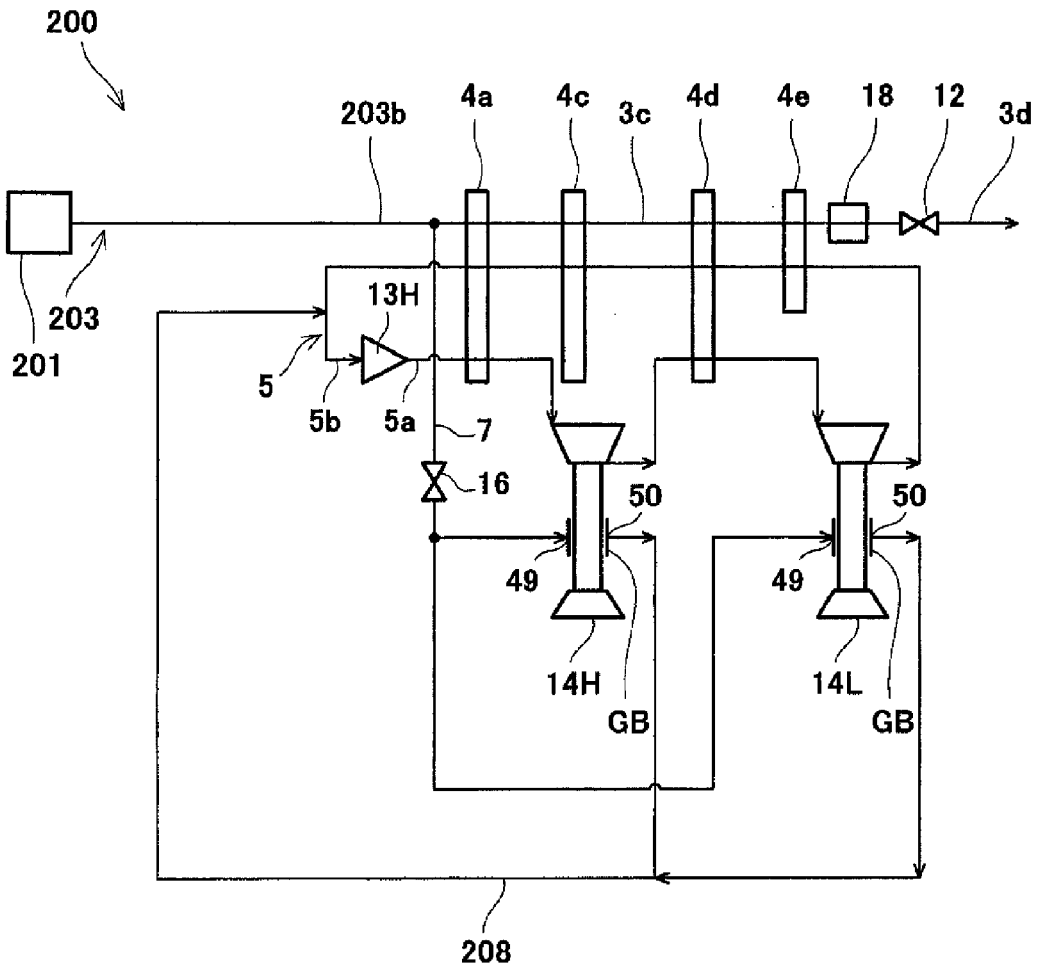
FIG. 5 is a conceptual diagram showing a configuration of main parts of a liquefier system according to Embodiment 2 of the present invention.

FIG. 5 is a conceptual diagram showing a configuration of main parts of a liquefier system 200 according to Embodiment 2 of the present invention. Hereinafter, the present embodiment is described focusing on differences from the above-described embodiment.

As shown in FIG. 5, in the liquefier system 200 according to the present embodiment, no feeding compressor is provided on a feed line 203. Instead, the raw material tank 201 stores the raw material gas whose pressure has been increased to the outlet pressure of the feeding compressor 11 of the above-described embodiment. In this case, the pressure of the raw material gas that is in a gaseous state and that flows through the feed line 203 from the raw material tank 201 to the inlet of the Joule-Thomson valve 12 is kept at a high pressure higher than or equal to the predetermined pressure P0 regardless of the load on, for example, the high-pressure circulation compressor 13H. Thus, it is not essential to provide a feeding compressor on the feed line 203.

Further, in this case, as shown in FIG. 5, the upstream end of the bearing supply line 7 may be connected to a passage 203*b* of the feed line 203, the passage 203*b* extending from the raw material tank 201 to the first heat exchanger 4*a*. As a result, similar to the above-described embodiment, the high-pressure bearing gas can be stably supplied to the static pressure gas bearing unit GB. The passage 3*c* from the first heat exchanger 4*a* to the inlet of the Joule-Thomson valve 12 is a portion through which the raw material gas that has a pressure higher than or equal to the predetermined pressure P0 flows in a gaseous state. Therefore, the upstream end of the bearing supply line 7 may be connected to the passage 3*c*. In this case, similar to the above-described embodiment, the temperature difference between the cooling medium and the bearing gas in the housing 21 is small, which makes it possible to reduce thermal influence of the bearing gas on the cooling medium.

In the present embodiment, the feed line 203 does not include a portion through which the raw material gas that has a low pressure flows in a gaseous state. For this reason, it is difficult to reuse the bearing gas as the raw material gas by connecting the downstream end of a bearing gas return line 208 to the feed line 203. In view of this, as shown in FIG. 5, the downstream end of the bearing gas return line 208 may be connected to the return passage 5*b* of the cooling medium circulation line. In this case, the downstream end of the bearing gas return line 208 may be connected to a portion of the return passage 5*b*, in which portion the temperature of the cooling medium is close to the temperature of the bearing gas. For example, the downstream end of the bearing gas return line 208 may be connected to a portion through which the cooling medium returns from the first heat exchanger 4*a* to the circulation compressor 13H. Since the bearing gas is the same gas as the cooling medium, even if the bearing gas is reused as the cooling medium, there is not a risk of a different kind of gas being mixed into the cooling medium. For the purpose of preventing impurities in the bearing gas from being mixed into the cooling medium, an adsorber configured to adsorb the impurities may be provided on the bearing gas return line 208.

Embodiment 3

Figure 6:
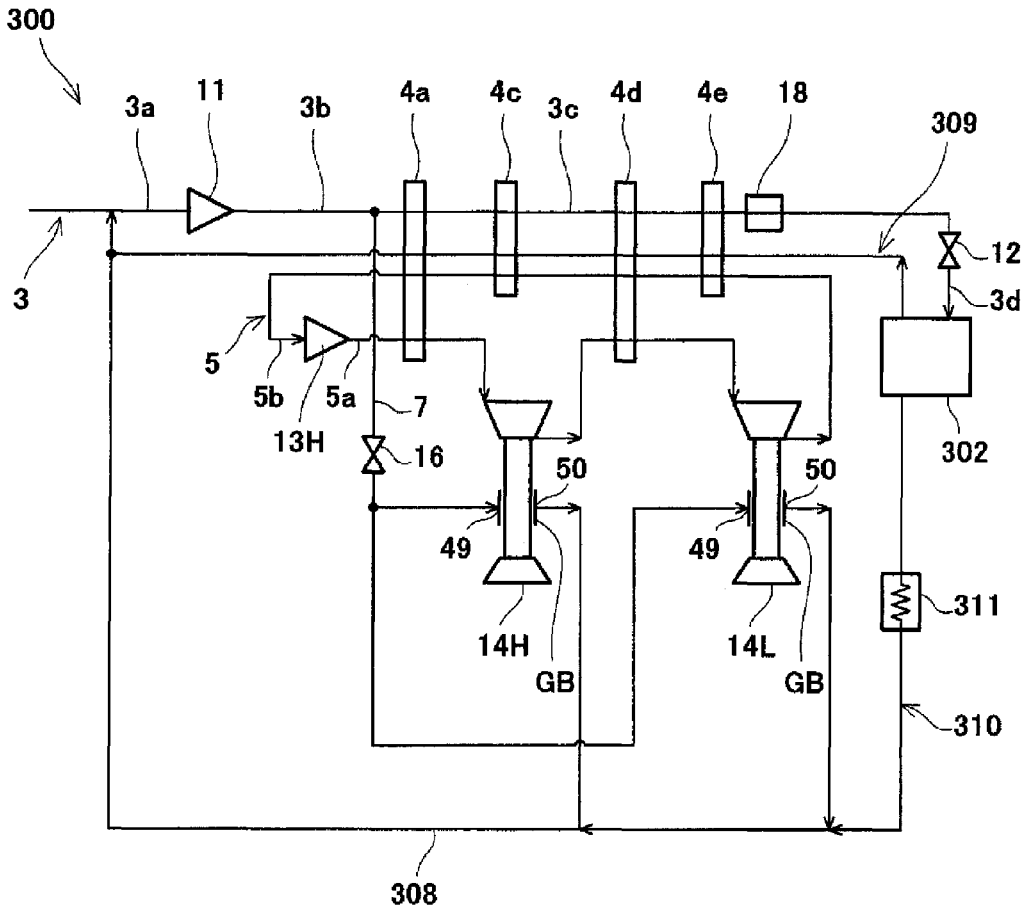
FIG. 6 is a conceptual diagram showing a configuration of main parts of a liquefier system according to Embodiment 3 of the present invention.

FIG. 6 is a conceptual diagram showing a configuration of main parts of a liquefier system 300 according to Embodiment 3 of the present invention. Hereinafter, the present embodiment is described focusing on differences from the above-described embodiments.

As shown in FIG. 6, the liquefier system 300 according to the present embodiment is configured such that similar to Embodiment 1, the feeding compressor 11 is provided on the feed line 3, and a bearing gas return line 308 connects the bearing gas outlets 50 to the passage 3*a* of the feed line 3, the passage 3*a* being positioned upstream from the feeding compressor 11. The liquefier system 300 includes boil-off gas return lines 309 and 310, through which a boil-off gas generated in a liquefied hydrogen tank 302 is returned. The boil-off gas return lines 309 and 310 are connected to the bearing gas return line 308. Accordingly, in the present embodiment, the bearing gas and also the boil-off gas can be reused as the raw material gas and the bearing gas. It should be noted that the heat exchangers 4*a* to 4*e*, the liquefied hydrogen reservoir 18, and the turbine portions of the expansion turbines 14H and 14L are accommodated in a cold box (low-temperature box) for keeping them cold.

The temperature of the boil-off gas in the liquefied hydrogen tank 302 is a low temperature close to the boiled point of liquefied hydrogen. Therefore, the boil-off gas return line 309 is configured such that, from the liquefied hydrogen tank 302 to a connection point where the boil-off gas return line 309 is connected to the bearing gas return line 308, the boil-off gas return line 309 extends through the fifth heat exchanger 4*e*, the fourth heat exchanger 4*d*, the third heat exchanger 4*c*, and the first heat exchanger 4*a* in said order. Accordingly, the coldness of the boil-off gas can be utilized for cooling down the raw material gas and the cooling medium that flows through the outward passage 5*a*, and the loads on the circulation compressors 13H and 13L and the expansion turbines 14H and 14L on the cooling medium circulation line 5 can be reduced. On the other hand, the boil-off gas return line 310 is configured such that, from the liquefied hydrogen tank 302 to a connection point where the boil-off gas return line 310 is connected to the bearing gas return line 310, the boil-off gas return line 310 does not extend through any of the heat exchangers. Instead, a heater 311 is provided on the boil-off gas return line 310. The heater 311 serves to heat the boil-off gas that flows from the liquefied hydrogen tank 302 to the bearing gas return line 308. This makes it possible to reduce a temperature difference and reuse the boil-off gas.

From the foregoing description, numerous modifications and other embodiments of the present invention are obvious to one skilled in the art. Therefore, the foregoing description should be interpreted only as an example and is provided for the purpose of teaching the best mode for carrying out the present invention to one skilled in the art. The structural and/or functional details may be substantially altered without departing from the spirit of the present invention. For example, the boil-off gas return lines according to Embodiment 3 may be applied to the liquefier system 200 according to Embodiment 2. Even in a case where a compressor is provided on the feed line 3, the downstream end of the bearing gas return line may be connected to the outward passage of the cooling medium circulation line. In such a configuration, the boil-off gas return lines may be applied. Either one of the boil-off gas return lines 309 and 310 according to Embodiment 3 may be eliminated. In the case of applying both of the boil-off gas return lines 309 and 310, the liquefier system may be configured to switch between the return lines 309 and 310 so as to be able to select which line to use for returning the boil-off gas. In order to realize such a switching function, an on-off valve may be provided on each line.

In the above-described embodiments, the source of supply of the raw material gas is a raw material tank. However, the source of supply may be a plant where the raw material gas is produced. In this case, a normal-pressure or high-pressure raw material gas generated by the plant is fed into the feed line 3. Although in the above embodiments the raw material gas is a hydrogen gas, the present invention is also suitably applicable to a liquid helium producing system or a liquid neon producing system.

INDUSTRIAL APPLICABILITY

The present invention provides a functional advantage of being able to provide a liquefier system capable of stably supplying, to a static pressure gas bearing, a gas having a necessary pressure for supporting a rotating shaft of an expansion turbine without requiring the installation of a dedicated compressor on a line through which the gas is supplied to the static pressure gas bearing. The present invention is widely applicable to liquefier systems that include a static pressure gas bearing configured to support a rotating shaft of an expansion turbine.

REFERENCE SIGNS LIST

100, 200, 300 liquefier system
1, 201 raw material tank
2, 302 liquefied hydrogen tank
3, 203, 303 feed line
4*a*, 4*b*, 4*c*, 4*d*, 4*e* heat exchanger
5 cooling medium circulation line
7 bearing supply line
8, 208, 308 bearing gas return line
309, 310 boil-off gas return line
11 feeding compressor
12 Joule-Thomson valve
13H high-pressure circulation compressor
13L low-pressure circulation compressor
14H high-pressure expansion turbine
14L low-pressure expansion turbine
15 Joule-Thomson valve
16 pressure regulating valve
18 liquid reservoir
22 rotating shaft
27 upper static pressure thrust gas bearing
28 lower static pressure thrust gas bearing
29 upper static pressure journal gas bearing
30 lower static pressure journal gas bearing
GB static pressure gas bearing unit
49 bearing gas inlet
50 bearing gas outlet

The invention claimed is:

1. A liquefier system comprising:

a feed line configured to feed a raw material gas from a raw material supply source;

a circulation compressor configured to compress a cooling medium;

an expansion turbine configured to reduce a temperature of the cooling medium by expansion, the cooling medium having been compressed by the circulation compressor;

a heat exchanger configured to cool down the raw material gas that flows through the feed line by means of the cooling medium whose temperature has been reduced by the expansion turbine;

a cooling medium circulation line configured to guide the cooling medium from the circulation compressor to the expansion turbine and return the cooling medium from the expansion turbine to the circulation compressor through the heat exchanger;

a controller configured to control operations of the expansion turbine and the circulation compressor such that a high-load operation and a low-load operation are performed, the high-load operation being an operation in which a pressure of the cooling medium that flows through a portion of the cooling medium circulation line, the portion extending from the circulation compressor to the expansion turbine, becomes greater than or equal to a predetermined pressure, the low-load operation being an operation in which the pressure of the cooling medium that flows through the portion of the cooling medium circulation line becomes less than the predetermined pressure, the controller driving the circulation compressor and the expansion turbine to rotate regardless of whether the high-load operation or the low-load operation is being performed, such that the cooling medium circulates through the cooling medium circulation line;

a static pressure gas bearing configured to rotatably support a rotating shaft of the expansion turbine; and a bearing supply line configured to supply a gas to the static pressure gas bearing through the bearing supply line, wherein the predetermined pressure is a pressure necessary for the static pressure gas bearing to support the rotating shaft, a pressure of the raw material gas in a predetermined portion of the feed line is kept greater than or equal to the predetermined pressure regardless of whether the high-load operation or the low-load operation is being performed, and the bearing supply line connects the predetermined portion of the feed line to a gas inlet of the static pressure gas bearing, such that the raw material gas that flows through the feed line and whose pressure is greater than or equal to the predetermined pressure is supplied to the static pressure gas bearing as the gas.

2. The liquefier system according to claim 1, wherein the predetermined portion is positioned upstream from the heat exchanger on the feed line.

3. The liquefier system according to claim 1, further comprising a pressure regulating valve provided on the bearing supply line and configured to reduce the pressure of the gas that flows through the bearing supply line.

4. The liquefier system according to claim 1, further comprising:

a feeding compressor provided on the feed line at a position upstream from the predetermined portion and configured to compress the raw material gas; and a bearing gas return line configured to connect a gas outlet of the static pressure gas bearing and a portion of the feed line, the portion being positioned upstream from the feeding compressor, such that the gas that flows out of the gas outlet is returned to the feed line.

5. The liquefier system according to claim 4, further comprising:

a tank for storing the raw material gas that has been liquefied; and a boil-off gas return line through which a boil-off gas generated in the tank is returned to the feed line, wherein the boil-off gas return line is connected to the bearing gas return line.

6. The liquefier system according to claim 1, wherein the cooling medium is the same as the raw material gas.

7. The liquefier system according to claim 6, further comprising:

a bearing gas return line configured to connect a gas outlet of the static pressure gas bearing and a portion of the cooling medium circulation line, the portion extending from the expansion turbine to the circulation compressor, such that the gas that flows out of the gas outlet is sent to the cooling medium circulation line.

8. A liquefier system comprising:

a feed line configured to feed a raw material gas from a raw material supply source;

a cooling medium circulation line configured such that, while the system is in operation, the cooling medium circulation line (i) is separated from the feed line, (ii) forms a circulation line independently of the feed line, and (iii) causes a cooling medium to circulate;

a heat exchanger configured to cool down the raw material gas that flows through the feed line by means of the cooling medium that flows through the cooling medium circulation line;

an expansion turbine provided on the cooling medium circulation line and configured to reduce a temperature of the cooling medium by expansion;

a circulation compressor provided on the cooling medium circulation line and configured to compress and guide the cooling medium to the expansion turbine;

a controller configured to control operations of the expansion turbine and the circulation compressor such that a high-load operation and a low-load operation are performed, the high-load operation being an operation in which a pressure of the cooling medium that flows through a portion of the cooling medium circulation line, the portion extending from the circulation compressor to the expansion turbine, becomes greater than or equal to a predetermined pressure, the low-load operation being an operation in which the pressure of the cooling medium that flows through the portion of the cooling medium circulation line becomes less than the predetermined pressure, the controller driving the circulation compressor and the expansion turbine to rotate regardless of whether the high-load operation or the low-load operation is being performed, such that the cooling medium circulates through the cooling medium circulation line;

a static pressure gas bearing configured to rotatably support a rotating shaft of the expansion turbine; and a bearing supply line configured to supply a gas to the static pressure gas bearing, wherein the predetermined pressure is a pressure necessary for the static pressure gas bearing to support the rotating shaft, a pressure of the raw material gas in a predetermined portion of the feed line is kept greater than or equal to the predetermined pressure regardless of whether the high-load operation or the low-load operation is being performed, and the bearing supply line connects the predetermined portion of the feed line to a gas inlet of the static pressure gas bearing, such that the raw material gas that flows through the feed line and whose pressure is greater than or equal to the predetermined pressure is supplied to the static pressure gas bearing as the gas.

* * * * *